United States Patent [19]

Streubel et al.

[11] Patent Number: 4,811,779

[45] Date of Patent: Mar. 14, 1989

[54] MOLD FOR THE CONTINUOUS CASTING OF STEEL STRIP

[75] Inventors: Hans Streubel, Erkrath; Rainer Golla, Dusseldorf; Manfred Kolakowski, Erkrath, all of Fed. Rep. of Germany

[73] Assignee: SMS Schloemann-Siemag Aktiengesellschaft, Dusseldorf, Fed. Rep. of Germany

[21] Appl. No.: 129,247

[22] Filed: Dec. 7, 1987

[51] Int. Cl.[4] ..... B22D 11/00

[52] U.S. Cl. ..... 164/418; 164/459

[58] Field of Search ..... 164/418, 459, 435

[56] References Cited

U.S. PATENT DOCUMENTS

| | | | |
|---|---|---|---|
| 4,207,941 | 6/1980 | Shrum | 164/418 |
| 4,635,702 | 1/1987 | Kolakowski et al. | 164/418 |
| 4,716,955 | 1/1988 | Fastert | 164/418 |
| 4,721,151 | 1/1988 | Streubel | 164/418 |

*Primary Examiner*—Kuang Y. Lin

[57] ABSTRACT

The invention provides a mold for the continuous casting of steel strip. The mold is arranged with a mold cavity having a longitudinal axis parallel to the casting direction. The width of the cavity in its upstream area is sufficient to provide at least the required minimum spacing between the pouring tube and the walls of the mold. The mold comprises side- and end-walls arranged respectively to define a cavity having three portions, the first being of substantially the same parallelepipedal cross-section as the strip being cast; the second being a flared area in the upper central area of the mold to accommoate a pouring tube, wherein the side-walls are tapered inwardly from the upper part of the mold to a lower point at which the cross-section of the mold approximates the size and shape of the strip being cast; and the third being a strand shell formation initialization zone in the flared area having walls extending in substantial alignment with the longitudinal axis of the mold from the surface level of the molten bath at which the strand shell starts to form, to a point where the strand shell is sufficiently thick to withstand tapering inwardly without wrinkling or rupturing.

3 Claims, 3 Drawing Sheets

MOLD FOR THE CONTINUOUS CASTING OF STEEL STRIP

FIELD OF THE INVENTION

This invention relates to open-ended, ingot molds for the continuous casting of strip steel, and more particularly to the internal configuration of such molds in the upper area around the pouring tube through which the molten metal enters the continuous casting mold from the tundish. Still more particularly, the invention relates to the design of the internal contour of the mold in the upper area, to minimize the risk of wrinkle formation in the surface of the casting and consequent risk of local bleeding as well as to promote rapid continuous casting.

BACKGROUND OF THE INVENTION

Continuous casting molds of the same general type as that of this invention, have been known for many years, see e.g., German Pat. No. DE-PS 887,990. They are formed with generally parallel side walls, which are provided with internal cooling and which define a mold cavity having a cross section in the shape of an elongated parallelepiped corresponding to the approximate size and shape of the strip being cast. The upper area of the mold into which the molten metal is poured through the pouring tube is generally funnel-shaped or flared sufficiently to provide room for the tube (plus a necessary "safety" clearance), with the walls tapering down below the tube to the configuration of the strip being cast. During pouring and while the continuous casting is in progress, the level of the molten metal is maintained substantially above the exit ports of the pouring tube, and due to the cooling, the metal commences to congeal while still in the flared area, where it initially develops a thin and relatively fragile strand casting shell in the upper area of the mold. The amount of flare in the upper area of the mold is determined by the diameter of the pouring tube, the desired immersion depth of the pouring tube, and the required clearance between the pouring tube and the side walls of the mold.

One problem with such molds in use is that the nascent, and hence fragile, strand shell in the upper area of the mold tends to form wrinkles due to the decrease in surface area of the mold as it tapers down to the final size and shape of the casting. Such wrinkles should be avoided because they introduce problems during the further processing of the product by rolling, which problems become more serious the thinner the cast strip is. Also such wrinkles tend to increase the risk of local bleeding from the liquid core of the casting toward the surface. The tendency to form wrinkles, however, also increases as the angle of the flared area of the mold increases. The result is effectively to limit the thickness of the strip being cast because the pouring tube cannot be smaller than a given minimum diameter, and if the upper part of the flared area is fixed, the lower part cannot be decreased in thickness without increasing the flare angle which, in turn increases the risk of forming wrinkles.

OBJECTS OF THE INVENTION

A general object of the invention is to minimize the risk of forming wrinkles. Secondarily an object is to increase the speed of wrinkle-free casting. More specifically, an object of the invention is to provide for the formation of the strand shell under conditions in which the risk of wrinkles, bleeding and/or rupture is minimized in the area where the nascent shell is thin and vulnerable, thereby allowing more wrinkle-free and faster casting.

BRIEF DESCRIPTION OF THE INVENTION

In the accomplishment of these and other objects of the invention, in a preferred embodiment thereof, the mold is provided with a strand shell formation initializing zone in the pouring area of the mold which zone extends from near to the surface level of molten metal bath (during casting), downwardly to a point where the strand shell is sufficiently thick to withstand tapering inwardly without wrinkling in which zone the mold walls run in substantially parallel alignment with the casting axis so that there is no, or very little, geometric reduction of the surface area in the zone due to inward incline of the walls. It is a feature of the invention, that this axial, or slightly inclined inward, alignment of the walls in the strand shell formation initializing zone, allows the nascent shell to build up to a degree without appreciable reduction of the surface area of the mold walls. In this way it provides a maximum of freedom from stress in the shell during the critical period of initial build-up. A further feature of the invention is that the axial length of the parallel walled initializing zone is selected to be long enough (considering the cooling and throughput rates) to ensure the formation of a relatively tough strand shell of sufficient thickness before the start of the inward taper of the mold. The shell must be strong enough to withstand tapering inwardly without rupture, but still weak (plastic) enough under the static pressure of the liquid core of the casting to remain pressed into conformity with the mold wall and not to wrinkle despite undergoing a reduction of its surface area due to the inward taper. The dimension of the parallel walled zone from the point at which the strand shell starts to form to its lower end is between 50 and 250 mm. Still another feature of the invention is that the parallel walled zone may advantageously be extended above the surface level of the molten metal bath. When this is done, it enhances strand shell formation by avoiding the tendency of the metal and nascent shell to make stress inducing contact with the mold walls during the upward stroke of the normally applied axial oscillation of the mold. In addition an axial extension of the parallel walled zone above the level of the molten bath, is that it permits varying the axial dimension of the initializing zone by increasing or decreasing the surface level of the molten bath, which may be desirable when using different casting speeds with the same mold. A further feature of the invention is that the parallel walled zone (a) extends up to the top of the mold and its complete dimension is between 150 and 350 mm. The mold walls at the end and immediately below the initializing zone are curved gradually so as to avoid any sharp change of direction which might otherwise create stress in the strand shell as the mold tapers down to the cross sectional shape of the strip being cast.

BRIEF DESCRIPTION OF THE DRAWINGS

A preferred embodiment of the invention selected for purposes of illustration only and herein described is shown in the following drawings in which.

DETAILED DESCRIPTION OF THE MOLD

Figure 1:
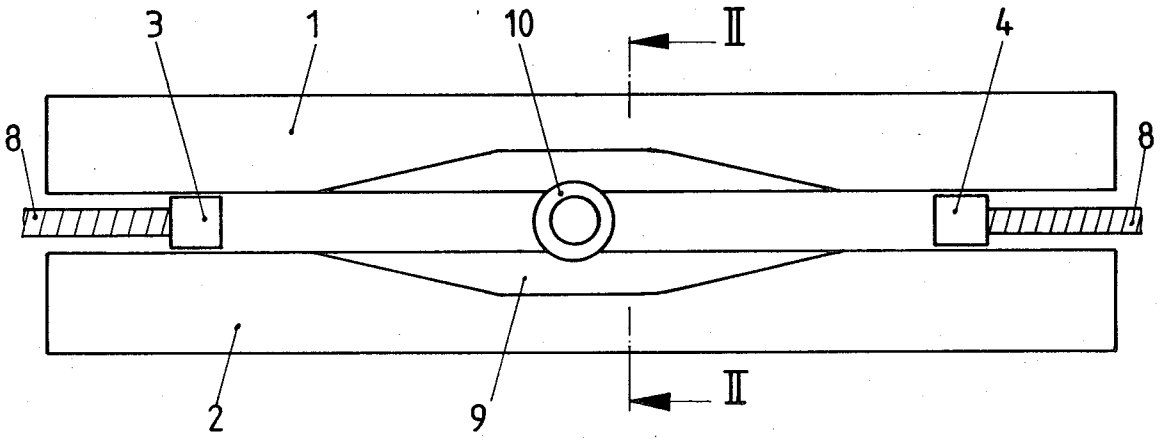
FIG. 1 is a plan view from above of the strip casting mold of the invention.

The embodiment of the mold of the present invention selected for illustration and shown herein comprises a mold made up of broad side walls 1, 2 and narrow end walls 3,4 arranged to provide a generally parallelepiped mold cavity which is flared in its upper area to accomodate a pouring tube 10. The mold walls are cooled by cooling liquid passing within the walls through channels 5 fed by openings 6, 7. The end walls 3,4 are also similarly cooled by channels not shown and are adjustable by means of screws 8.

Figure 2:
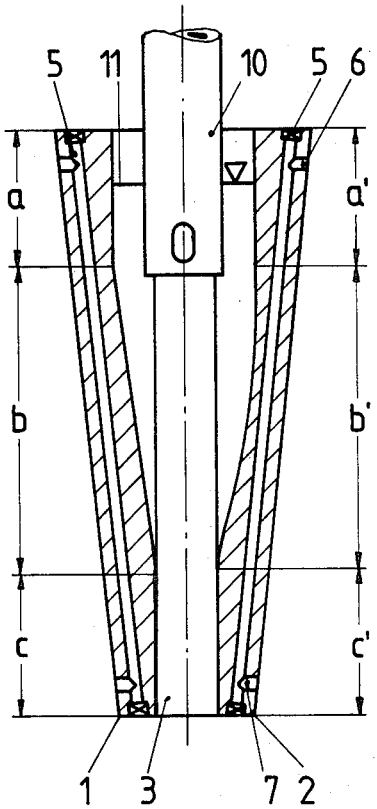
FIG. 2 is a sectional view in end elevation taken along the lines II—II of FIG. 1.
Figure 3:
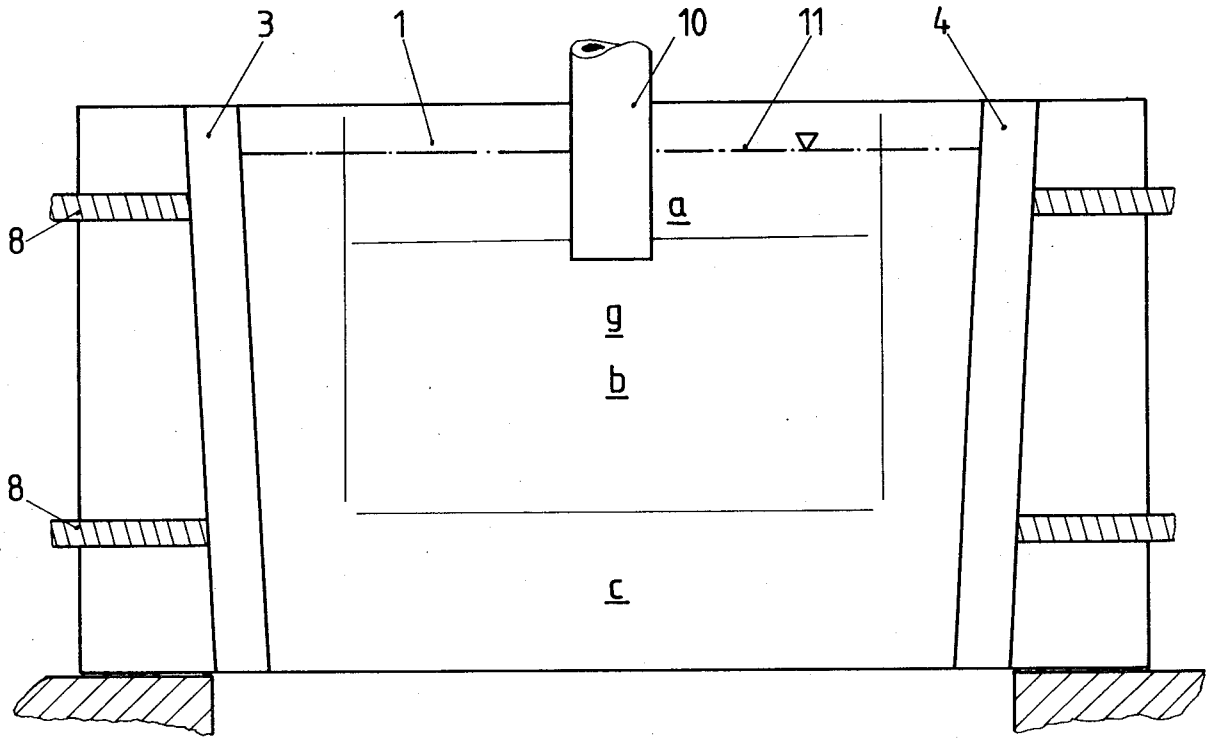
FIG. 3 is a sectional view in side elevation of one half of the mold as seen from within the mold cavity.

The upper, flared portion of the mold cavity is contoured to form a strand shell formation initializing zone 9 in which the walls of the mold run substantially parallel to the axis of the mold. As can be seen in FIG. 2, the zone 9 starts from above the level 11 of the molten metal bath down to about the level of the lower end of pouring tube 10 (see left hand side of FIG. 2, or, preferrably to a point which is substantially therebelow as seen on the right hand side of FIG. 2. Three general sections are designated in FIG. 2, comprising an upper section a—a′, a middle section b—b′, and a lower section c—c′. In section a—a′, the metal is largely molten and the strand shell is just starting to form (i.e., from zero to about 4 mm in thickness). In section b—b′, the strand shell is increasing in thickness (i.e., from about 4 mm to about 8 mm in thickness). In section c—c′, the strand continues in the cross-sectional size and shape of the strip being cast. In the section a′—a′, the strand shell is commencing to form, and it is, therefore, referred to herein as the "initializing zone". In this zone, the shell is preferrably formed to a thickness of about 4 mm. Such a shell thickness is strong enough to withstand reduction of its surface area, and at the same time, weak (pliant) enough to adapt, under the static pressure of the molten metal in the core of the casting, to the changing configuration down to the eventual size of the casting without wrinkling. Preferrably all of the corners between the respective sections are curved so as to avoid any stress producing lines (see right hand side of FIG. 2). The length of section a—a′ is between about 150 mm and 350 mm depending on the casting speed range, in order to provide a shell thickness of about 4 mm at the end of the initializing zone a—a′.

Having thus described an illustrative embodiment, it will now be apparent to those skilled in the art that modifications of the invention can be made without departing from the spirit of the invention. For example, the walls in the shell formation initializing zone 9 may be tapered inwardly slightly, so as to produce a mild pressure contact between the strand shell and the mold wall during the upstroke of the normal oscillation of the mold without causing wrinkles in or rupture of the strand shell. Also, the mold shape may be varied, as well as the configuration of the end of the pouring tube. For example, for casting extremely thin strip, the end of the tube will be preferrably fan-shaped to provide distribution of the molten metal and at the same time a thin transverse dimension. Accordingly, it is not intended to confine the invention to the precise form herein shown but rather to limit it only in terms of the appended claims.

We claim:

1. A mold for continuously casting strip metal in which said mold is arranged with a mold cavity having a longitudinal axis parallel to the casting direction and a portion centrally of and in the upstream area of said mold dimensioned to accomodate a pouring tube positioned in the upstream area of said cavity during casting, the width of said cavity in said upstream area being sufficient to provide equal to, or greater than, a required minimum spacing between said pouring tube and the walls of said mold, said mold comprising:

(a) side and end walls for said mold arranged respectively to define said cavity and positioned to make the cross-section of said cavity shaped generally as a parallelepiped have substantially the same dimensions as the strip being cast, and said cavity also having a flared area in the upper central area of said mold to accomodate the pouring tube, said side walls being tapered inwardly from the upper part of the mold to a lower point at which the cross-section of the mold approximates the size and shape of the strip being cast; and (b) a strand shell formation initializating zone in said flared area having walls extending substantially parallel with the longitudinal axis of said mold, the parallel wall zone extending up to the top of the mold, and the complete dimension of the parallel wall zone being between 150 and 350 mm.

2. The mold defined in claim 1 further characterized by:

the axial dimension of said strand shell formation initializing zone from the point at which the strand shell starts to form to its lower end being between 50 and 250 mm.

3. The mold defined in claim 1 further characterized by:

the wall at the end of and immediately below the initializing zone being curved gradually.

* * * * *